US008561656B2

(12) United States Patent
Eginton et al.

(10) Patent No.: US 8,561,656 B2
(45) Date of Patent: Oct. 22, 2013

(54) ADAPTABLE BENCH TOP FILLING SYSTEM

(76) Inventors: Michael Eginton, Glen Arm, MD (US); John M. Chopper, Pasadena, MD (US)

( * ) Notice: Subject to any disclaimer, the term of this patent is extended or adjusted under 35 U.S.C. 154(b) by 1021 days.

(21) Appl. No.: 12/590,095

(22) Filed: Nov. 2, 2009

(65) Prior Publication Data

US 2010/0116375 A1 May 13, 2010

Related U.S. Application Data

(60) Provisional application No. 61/197,894, filed on Oct. 31, 2008.

(51) Int. Cl.
*B65B 3/12* (2006.01)

(52) U.S. Cl.
USPC ..... 141/104; 141/83; 141/371; 222/135; 222/255

(58) Field of Classification Search
USPC ..... 141/83, 104, 370–371; 222/129, 222/136–138, 252, 255
See application file for complete search history.

(56) References Cited

U.S. PATENT DOCUMENTS

| | | | | |
|---|---|---|---|---|
| 4,485,941 | A | 12/1984 | Frates et al. | |
| 4,634,024 | A * | 1/1987 | Vollenweider | 222/135 |
| 5,027,978 | A * | 7/1991 | Roeser | 222/63 |
| 5,168,905 | A * | 12/1992 | Phallen | 141/1 |
| 5,308,320 | A | 5/1994 | Safar et al. | |
| 5,316,452 | A | 5/1994 | Bogen et al. | |
| 5,319,568 | A * | 6/1994 | Bezaire | 700/123 |
| 5,996,650 | A * | 12/1999 | Phallen et al. | 141/83 |
| 6,173,867 | B1 * | 1/2001 | Meyer | 222/255 |
| 6,422,428 | B1 * | 7/2002 | Allen et al. | 222/318 |
| 6,739,478 | B2 * | 5/2004 | Bach et al. | 222/1 |
| 6,761,191 | B2 * | 7/2004 | Rosen et al. | 141/91 |
| 6,800,069 | B2 | 10/2004 | Lampropoulos et al. | |
| 6,941,981 | B2 * | 9/2005 | Rosen | 141/85 |
| 7,418,981 | B2 * | 9/2008 | Baker et al. | 141/9 |
| 7,527,078 | B2 * | 5/2009 | Driessen et al. | 141/9 |
| 7,690,405 | B2 * | 4/2010 | Miller et al. | 141/104 |
| 8,272,537 | B2 * | 9/2012 | Varga | 222/146.5 |
| 2002/0139436 | A1 * | 10/2002 | Rosen et al. | 141/86 |
| 2004/0173284 | A1 * | 9/2004 | Rosen | 141/83 |
| 2006/0049209 | A1 * | 3/2006 | Baker | 222/252 |
| 2007/0012376 | A1 * | 1/2007 | Khoo et al. | 141/87 |
| 2007/0012378 | A1 * | 1/2007 | Miller et al. | 141/104 |
| 2007/0151984 | A1 * | 7/2007 | Baker et al. | 222/129 |
| 2008/0257912 | A1 * | 10/2008 | Bach et al. | 222/333 |
| 2009/0084816 | A1 * | 4/2009 | Varga | 222/138 |
| 2009/0261121 | A1 * | 10/2009 | Varga | 222/1 |
| 2011/0139814 | A1 * | 6/2011 | Mueller et al. | 222/1 |

* cited by examiner

*Primary Examiner* — Gregory Huson
*Assistant Examiner* — Nicolas A Arnett
(74) *Attorney, Agent, or Firm* — Ober, Kaler, Grimes & Shriver; Royal W. Craig

(57) ABSTRACT

A semi-automatic benchtop filling system that allows the user to switch between pump technologies while utilizing one base unit. The base unit is outfitted to accommodate peristaltic, lobe, gear, and piston pumps providing a maximum amount of flexibility and versatility in one unit. The base unit employs a computerized servo motor control system and docking hardware for driving any of the four different pump types. The system is designed to automate the filling of sample containers regardless of which pump is mounted by tare weighting, and the drive will adjust itself to dispense the correct weight. The pump drive includes appropriate reduction gearing and quick disconnect flexible couplings for each of the different pump types, a side-mounted adapter for connecting any of the peristaltic, gear and lobe pumps, and a separate piston drive assembly and dock-connector at the rear for a piston pump. The device includes a touch-screen interface with control software for user-setup, establishing different fill recipes, and run time.

9 Claims, 10 Drawing Sheets

ADAPTABLE BENCH TOP FILLING SYSTEM

CROSS-REFERENCE TO RELATED APPLICATIONS

The present application derives priority from provisional application 61/197,894 filed on Oct. 31, 2008 which is incorporated herein in its entirety by reference.

BACKGROUND OF THE INVENTION

1. Field of the Invention

The present invention relates generally to liquid filling systems and, more specifically, to a semi-automated bench top filling system that allows a user to switch between different pump technologies while utilizing a single drive and control unit.

2. Description of the Background

The production container filling industry is faced with a need for filling a wide variety of different types and sizes of containers with different fluids and for running batches as small as only a few units to hundreds or more units. Further, each production run involves specific product requirements that are generally a function of fluid parameters including fill volume (ranging from microliters to liters), viscosity, entrained solids, output volume or other product parameters. These parameters often dictate the use of a particular type of positive displacement pump. The term "positive displacement pump" as used herein refers to any type of pump that forces a fluid to move by displacing a trapped volume of the fluid from a chamber. Examples of positive displacement pumps include, but are not limited to, gear, lobe, piston, and peristaltic pumps.

Conventional filling systems are generally pump-specific in as much as they drive, for example, only a piston pump or only a peristaltic pump. As a result, an entirely separate filling system must be employed when the fluid parameters of different batches call for the use a different type of positive displacement pump. For example, Watson-Marlow Flexicon, a leading manufacturer of peristaltic filling systems and capping equipment for the pharmaceutical, bio-technology, and diagnostic industries, sells a Disposable Filling Machine™. This machine is a table-top pump that provides fast, accurate dispensing of pharmaceutical and biotechnology serums and fluids, permits easy product changeover, eliminates the risk of cross contamination, and simplifies aseptic filling and cleaning validation. However, a single peristaltic pump is used so that the system is not suitable for filling applications commanding a gear, lobe, or piston pump such as for example pumping of fluids having included particulate matter. A separate system utilizing, for example, a lobe pump would be required to be swapped in.

Acquiring and maintaining multiple pumping systems to be swapped in and out entails a significant investment in equipment and overhead and engenders costly "downtime" when changing from one product (or batch) to another. Such costs are obviously to be avoided and attempts have been made in other contexts to develop equipment to do so, notably in the context of medical pumps where it is necessary to swap out dirty pump cartridges for clean ones. Notable examples include U.S. Pat. No. 5,308,320 to Safar et al. (University of Pittsburgh) issued May 3, 1994, which discloses a portable and modular cardiopulmonary bypass apparatus with a pump 76 mounted on a pump console 90 by means of an interchangeable pump base 91 that facilitates attachment of various pump heads.

U.S. Pat. No. 5,316,452 to Bogen et al. (Gilbert Corp) issued May 31, 1994, shows a dispensing assembly utilizing compressible cartridges containing liquid reagents that are interchanged often. Each cartridge pump includes a reagent reservoir that directly empties into a metering chamber. The dispensing assembly may be mounted on a moveable platform, and the interchangeable pump cartridges can be easily exchanged.

U.S. Pat. No. 6,800,069 to Lampropoulos et al. (Merit Medical Systems) issued Oct. 5, 2004, shows a modularized infusion pump that allows a user to modify the configuration with one or more interchangeable manual or automatic pumps to inflate a pressure infuser bag. The modular configuration of the pressure infuser apparatus permits the user to detach and reattach a motorized pump and/or a manual pump to the pressure infuser bag quickly, easily, and efficiently without decreasing the air pressure of the pressure infuser bag.

In a non-medical context, U.S. Pat. No. 4,485,941 to Frates et al. (Nordson Corporation) issued Dec. 4, 1984, shows an apparatus for melting and dispensing thermoplastic material using either a reciprocating piston or a rotary gear pump, the two being interchangeable. Apparently hot melt manufacturers need to suit one line of equipment using rotary gear pumps, and another line of equipment using reciprocating piston pumps. However, no user-guidance is given for the changeover, so this process remains burdensome.

It would thus be desirable to provide a filling system that is capable of docking a gear, lobe, piston, or peristaltic pump and that substantially automates the accurate filling of containers regardless of which pump is mounted by utilizing a user-interface-guided tare weighting procedure to adjust to and dispense the correct amount of fluid by weight.

SUMMARY OF THE INVENTION

It is, therefore, an object of the present invention to provide a filling system capable of alternately docking a gear, lobe, piston or peristaltic pump.

It is another object to provide a filling system that substantially automates the filling of containers regardless of which type of pump is mounted.

It is another object to provide a filling system incorporating a user-interface-guided tare weighting procedure for setup with a gear, lobe, piston, or peristaltic pump, after which the system adjusts itself to dispense the correct fluid weight.

It is still another object to provide a filling system with adaptable pump drives including appropriate reduction gearing and quick disconnect flexible couplings for each of the different pump types, and adapters for connecting any of the pump types.

It is still another object to provide a filling system with software including a graphical user interface displayed on a touch-screen controller for convenient user-setup and establishing and storing various fill recipes and run times.

These and other objects are accomplished by a semi-automatic bench top filling system that allows the user to switch between different pump technologies while utilizing one base unit. The base unit is outfitted to accommodate peristaltic, lobe, gear, and piston pumps, providing maximum flexibility and versatility in one unit. The base unit employs a computerized servo motor control module and docking hardware for driving any of the four different pump types. The system is designed to automate the filling of sample containers regardless of which pump is mounted by tare weighting, and the drive will adjust itself to dispense the correct weight. The pump drive includes appropriate reduction gearing and quick disconnect flexible couplings for each of the different pump types, a side-mounted universal adapter for connecting a peristaltic, gear, or lobe pump, and a separate piston drive assembly and dock-connector at the rear for a piston pump. The device includes a touch-screen controller with control software for user-setup, establishing different fill recipes and run times.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Figure 1:
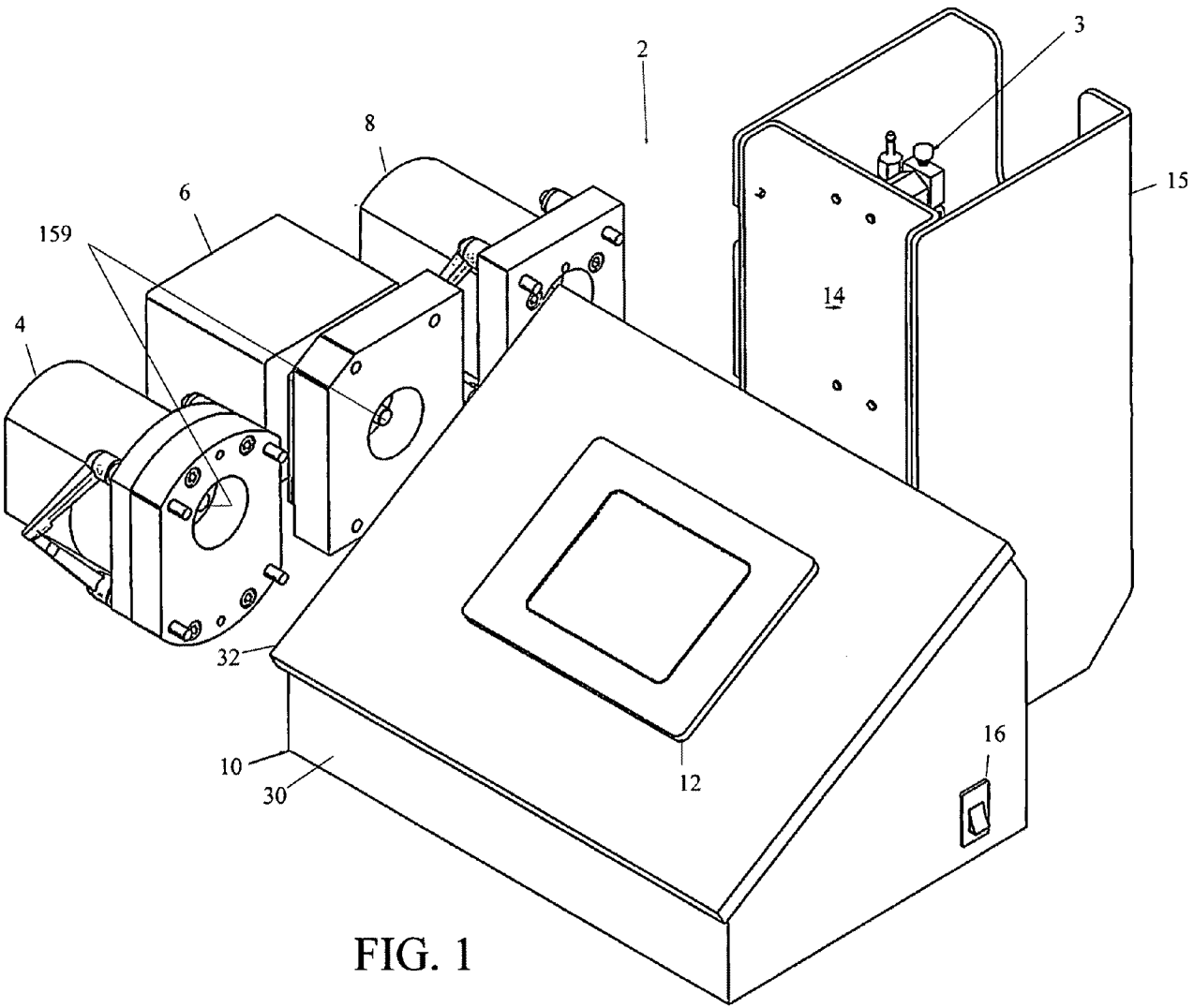
FIG. 1 is a right-side perspective view of a universal semi-automatic bench top filling system 2 according to a preferred embodiment of the present invention.

The present invention is a semi-automatic bench top filling system 2 that allows the user to switch between pump technologies while utilizing a single drive and controller unit. FIG. 1 is a right-side perspective view of a filling system 2 according to a preferred embodiment of the present invention that is equipped to alternately accommodate a peristaltic pump 6, lobe pump 4, gear pump 8, or piston pump 3. The base unit 10 houses an internal servo motor 40 (FIG. 2), a computerized servo motor control module 100 (FIG. 2), and docking mechanism for engaging and driving any of the four different pump types. The peristaltic pump 6, lobe pump 4, gear pump 8 alternately dock at the side of the base unit 10 as described below, while the piston pump 3 is supported on a rear mounting bracket 14 and coupled to a piston pump drive assembly 80 (also described below). The base unit 10 also includes a touch-screen controller interface 12 for user-setup and operation. The base unit 10 includes a removable cover panel 32 on a housing 30 with an aperture for seating a touch-screen controller 12.

Figure 2:
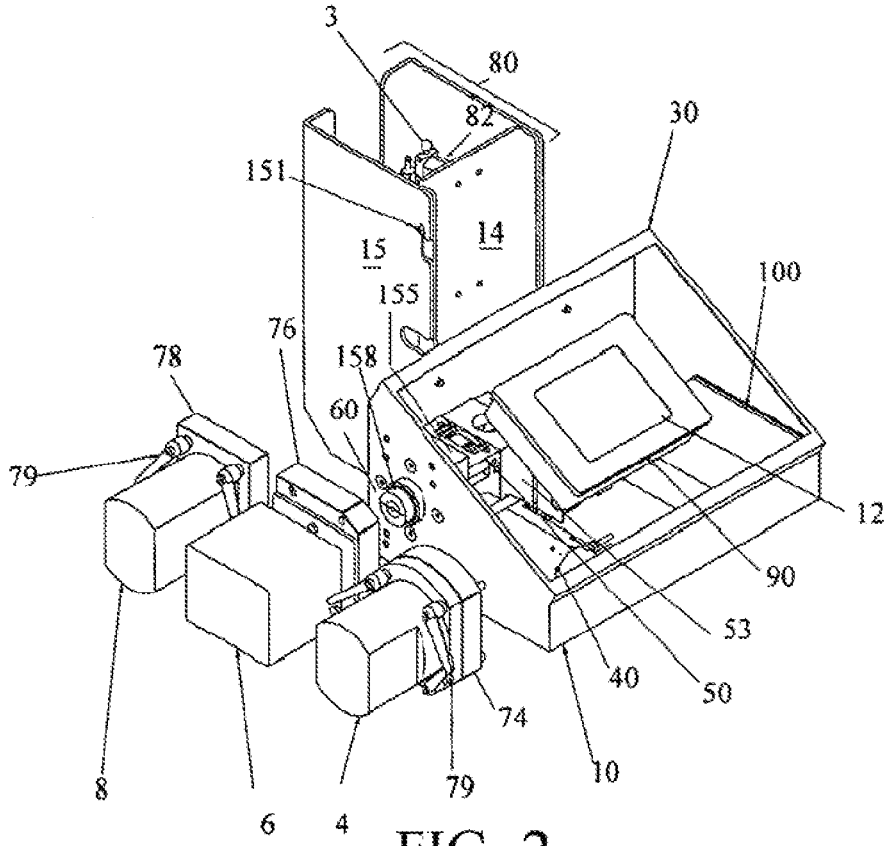
FIG. 2 is a left-side perspective view of the semi-automatic bench top filling system 2 as in FIG. 1, with cover panel 32 removed.

FIG. 2 is a left-side perspective view of the semi-automatic bench top filling system 2 as in FIG. 1, with cover panel 32 removed. As can now be seen in this preferred embodiment, the internal pump drive includes appropriate reduction gearing for each of the different pump types. The internal servo motor 40 is mounted to the left of touch-screen controller 12 while the servo motor control module 100 is seen to the right of the touch-screen controller 12. The servo motor 40 drives a reduction gearbox assembly 50 (see also FIGS. 4 and 5) that achieves a first order of reduction through gearbox 55, thereby rotating a quick disconnect flexible coupling 60 at the external side of the base unit 10 in order to drive the peristaltic pump 6, lobe pump 4, or gear pump 8. The reduction gearbox 55 is also coupled through a flexible coupling 53 to a supplemental reduction gearbox 56 (described below with regard to FIG. 4) which achieves a second order of reduction (for combined greater reduction) in order to drive the piston pump 3. The servo motor control module 100 drives the servo motor 40 for indexed rotation in either direction. Indexed rotation means that the motor control module 100 positively tracks angular rotation of the servo motor continuously or in very small steps or increments. Both may be commercial off-the-shelf components.

Figure 4:
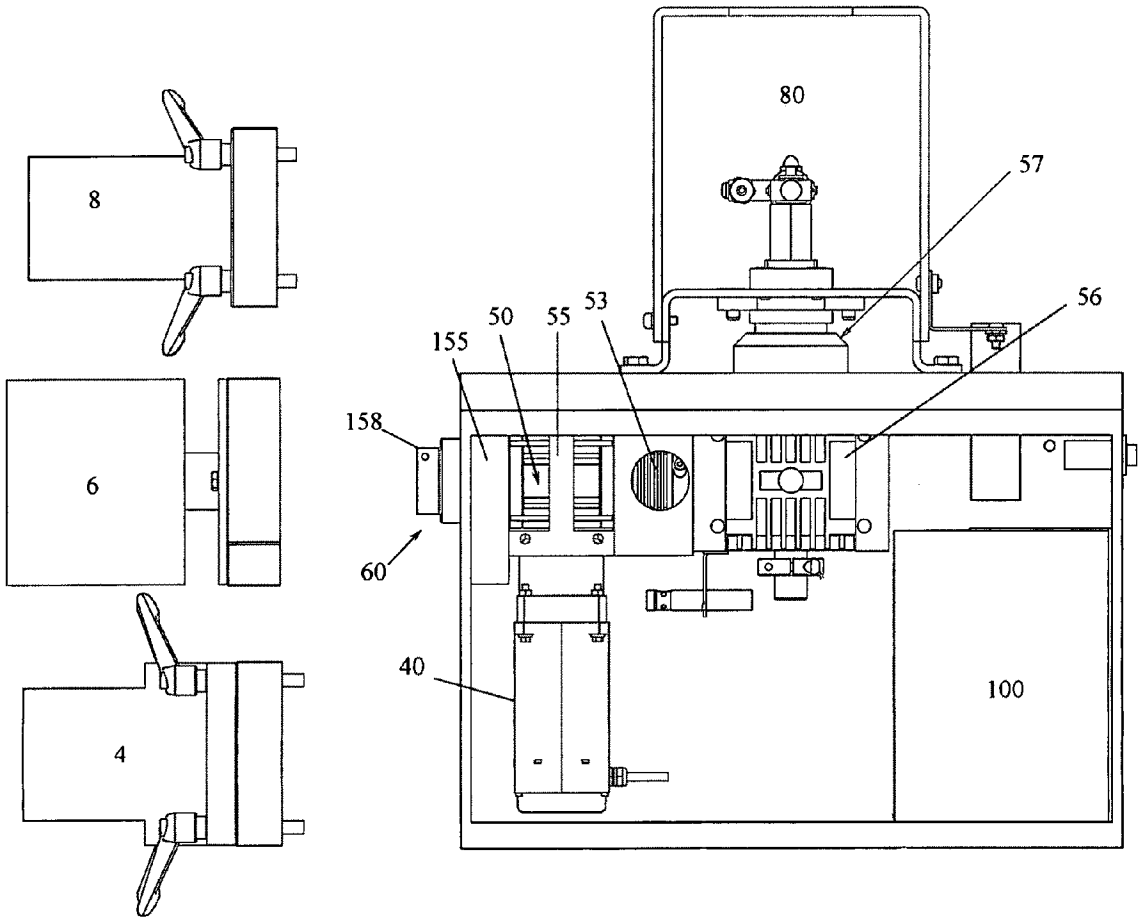
FIG. 4 is a top view of the bench top filling system 2 as in FIGS. 1-3 illustrating the internal layout.
Figure 5:
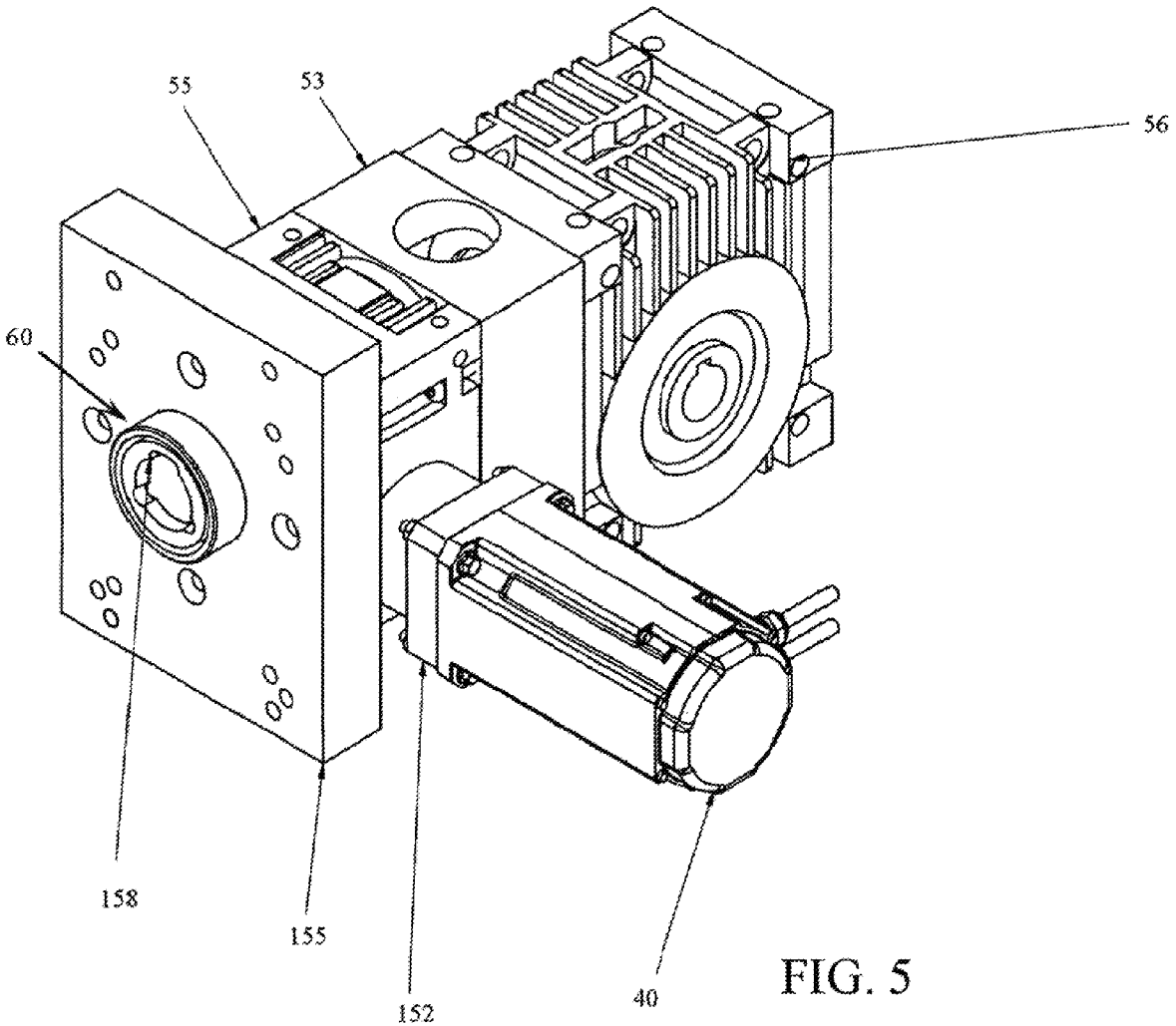
FIG. 5 is an enlarged view of the reduction gearbox assembly with servo motor 40 coupled thereto.

FIG. 4 is a top view of the bench top filling system 2 as in FIGS. 1 and 2 illustrating the internal layout while FIG. 5 is an enlarged view of the reduction gearbox assembly 50 with servo motor 40 coupled thereto. The internal pump drive includes servo motor 40 electrically connected to and controlled by servo-motor control module 100 providing pulse-width modulation speed control outputs to the servo motor 40. Servo motor 40 is mechanically connected at a mounting flange 152 to gearbox 55 in order to transfer rotary input to the gearbox. First stage reduction gearbox 55 preferably provides approximately a 6:1 gear ration via a servo worm gear reducer and translates the rotary input 90 degrees. The entire reduction gearbox assembly 50 is attached to the side of the base unit 10 by a universal mount 155 which is defined by a central aperture. The rotary output of the first stage reduction gearbox 55 is transferred through the central aperture of the universal mount 155 (and the side of the base unit 10) by a quick disconnect flexible coupling 60. The quick disconnect flexible coupling 60 includes a flexible coupling 158 connected to the output shaft of reduction gearbox 55.

Figure 3:
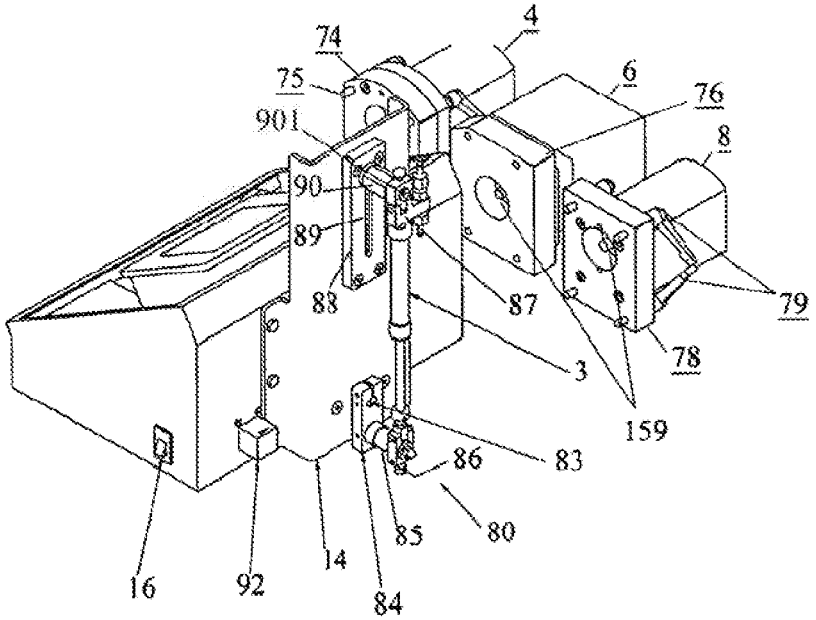
FIG. 3 is a rear perspective view of the semi-automatic bench top filling system 2 as in FIGS. 1-2.

The peristaltic pump 6, lobe pump 4, and gear pump 8 are equipped with docking adapters 76, 74, and 78, respectively (FIGS. 2 and 3). Adapters 76, 74, and 78 each comprising a mounting plate with a central, circular aperture and four corner-mounted twist-lock bayonet pins 75, 79 for engaging corresponding holes in the side of base unit 10 and mounting any of the three pumps 6, 4, or 8 to the side of the base unit 10. The central, circular aperture of adapters 76, 74, and 78 are occupied by a quick-connector 159 (FIG. 1) complimentary to the flexible coupling 158 such that the mounted pump is driven by rotation of the servo motor 40 via the reduction gearbox assembly 50. The flexible coupling/connector 158, 159 may be a commercially-available bellows coupling (16 mm o.d., 12 mm i.d.) and preferably includes a plurality of detent-bearings for snap-in receipt of the pump shaft.

A variety of commercially available servo motors 40 are suitable for the described application including for example the AKM12E manufactured by Danaher Motion in Radford, Va. The servo-motor control module 100 may be a 5200 Series Danaher Motion servo drive. The touch-screen controller 12 (FIG. 1) utilized to manage the servo-motor control module 100, as described below, may, for example, be a color touch-screen computer assembly from Maple Systems, such as their HMI5056T with a 6" display, 320×234 pixel resolution, and 65,536 colors.

The rotary output of the first stage reduction gearbox 55 is also transferred (on the other side) through the second flexible coupling 53 to the supplemental reduction gearbox 56. The second flexible coupling 53 may also be a commercially-available bellows coupling (16 mm o.d., 12 mm i.d.). The supplemental reduction gearbox 56 is attached inline with the first reduction gearbox 55 and, in the depicted embodiment, translates the rotary input 90 degrees to engage the piston pump drive assembly 80 at the rear of the base unit 10 via rotary shaft 83 (FIG. 3). A commercial gearbox with a reduction ratio of 11.25:1 or thereabout is preferred. Component 57 is a cover that seals the base unit 10 for protection from contaminates in the rearward area.

FIG. 3 is a rear perspective view of the semi-automatic bench top filling system 2 as in FIGS. 1-2 illustrating the piston mounting assembly 80 with a piston pump 3 mounted thereon. The safety guard 15 seen in FIGS. 1 and 2 has been removed in FIG. 3 for clarity. As can be seen in FIG. 2, the safety guard 15 is removably attached to the mounting bracket 14 by pin-in-groove mounts 151, the pin protruding from the mounting bracket 14. An interlock switch 92 (FIG. 3) is provided proximate to the safety guard 15 and is electrically coupled to the controller 100. The interlock switch 92 comprises a small detent switch that detects the absence/presence of the safety guard 15 to signal the controller 100 to remove power from the servo motor 40 thereby inhibiting operation of the piston drive assembly 80 and piston pump 3 whenever the safety guard 15 is removed.

Again with reference to FIGS. 2 and 3, the illustrated piston pump 3 is, for example, a National Instruments™/FILAMATIC® FUS-60 model piston pump which is designed for dispensing free flowing liquids in a continuous controlled flow, ensuring a quick fill within a range from 6 mL to 60 mL and with a fill accuracy of 0.5%. The piston pump 3 is rearwardly mounted on the mounting assembly 80 which is supported on the mounting bracket 14. A rotary shaft 83 protrudes rearwardly from base unit 10 through a flanged bearing attached to the wall of the mounting bracket 14. The rotary shaft 83 is connected within the base unit 10 to the supplemental reduction gearbox 56 which is itself connected to reduction gearbox 55 as described above. Externally, an eccentric arm 84 is mounted on the rotary shaft 83 and is generally an elongated rectangular block bisected at one end by a notch leading to a mounting hole for insertion of the rotary shaft 83. The eccentric arm 84 is tightened to rotary shaft 83 by compression of a bolt passing through the notched end. An offset lower pump post assembly 85 protrudes from eccentric arm 84 at an opposite end, and the plunger of the piston pump 3 is mounted to lower pump post assembly 85 where it is held captive by a setscrew 86 mounted on the lower swivel of piston pump 3. The lower pump post assembly 85 includes a V-shaped grooved bearing placed over a bearing sleeve. In this way, as the supplemental reduction gearbox 56 rotates the rotary shaft 83 the eccentric arm 84 and lower pump post assembly 85 translate the rotary motion into the linear up and down motion of the piston pump 3 plunger.

The upper end of the piston pump 3 is held captive by a thumb screw 901 on the upper swivel 87 of the piston pump, which is in turn mounted to an upper pump post assembly 90. The upper pump post assembly 90 is mounted to the mounting bracket 14 through the use of a mounting plate 88. Mounting plate 88 provides a vertically-adjustable mount for upper pump post assembly 90 by an elongated vertical slot 89. A fastener is mounted within the slot 89, and the upper swivel 87 of piston pump 3 is secured to the distal end of the upper pump post 90. The upper pump post 90 may use any suitable compression fitting, here shown as a hex-tightened bolt that may be adjusted along the slot 89 and tightened to secure it and the upper swivel 87 in place. In use, the vertically-adjustable mount for upper swivel 87 accommodates numerous types and sizes of commercially-available piston pumps of varying throw.

When operating the bench top filling system of the present invention, an operator selectively connects the peristaltic pump 6, lobe pump 4, gear pump 8, or piston pump 3 to base unit 10, and connects flexible tubing to the selected pump in preparation for container filling. The user turns the system 2 on using switch 16, which boots up the software for the touch-screen controller 12, and a menu appears on touch-screen controller 12 that allows a user to run a pre-defined fill recipe, modify a pre-defined recipe, or enter a diagnostic mode to use the automatic calibrate function to fine tune the fill weight. The calibration is a menu-guided setup procedure that includes tare weighing containers, filling the containers, weighing the filled containers, and calibrating the fill weight. Fill weights are entered via the touch-screen controller 12, and the system control software automatically adjusts the servo motor control module 100 to dispense the correct fluid weight based on the calibration.

Figure 6:
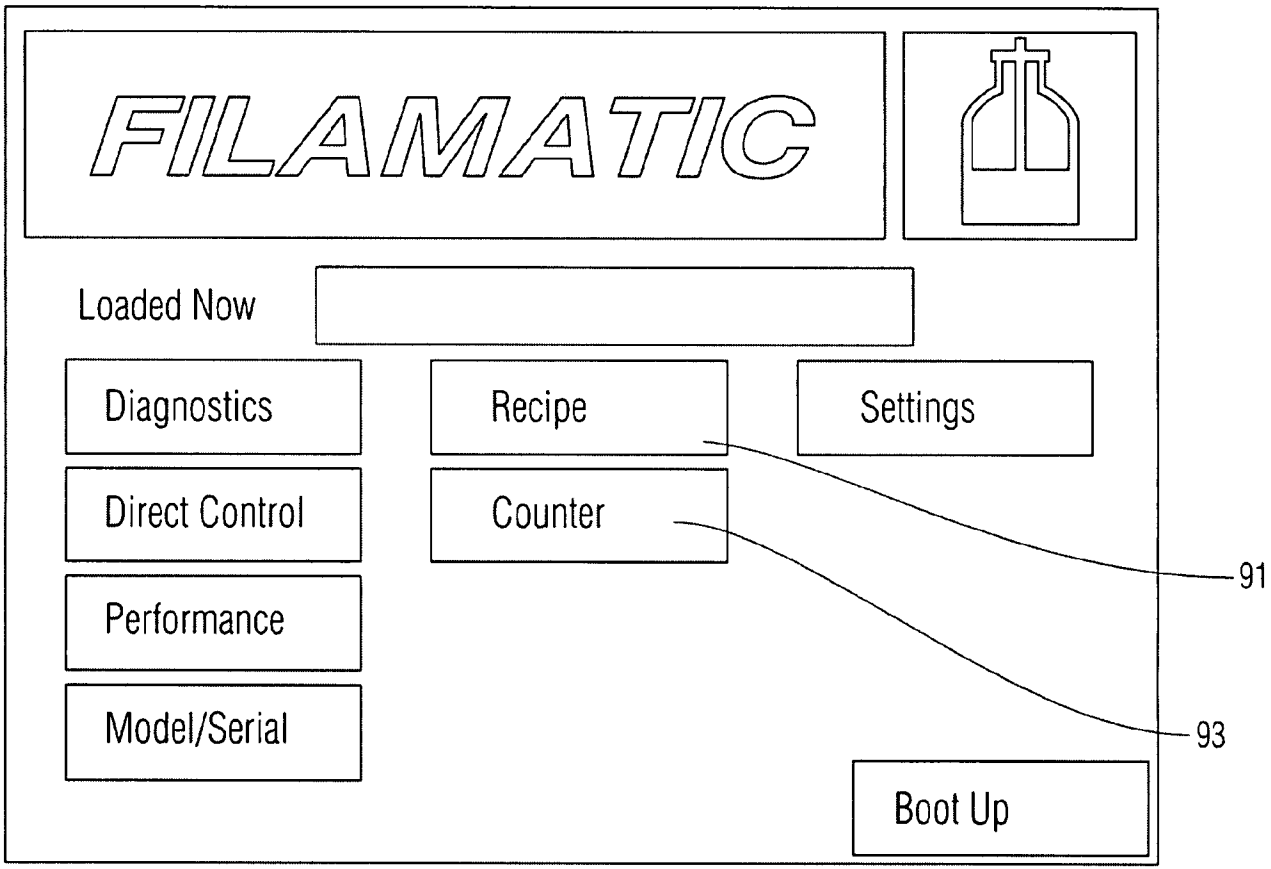
FIG. 6 is a screen print of an exemplary operator interface user-menu presented on the touch-screen controller 12.

FIG. 6 is a screen print of an exemplary operator interface user-menu presented on the touch-screen controller 12. The user-interface software allows simple and quick navigation between different modes through a simple touch of icons on the screen. The operator interface software allows a visual presentation of the overall state of the system, including the chosen mix recipe and defects in the recipe. With a secure access code, it is possible to use the touch screen to resolve any defects, coordinate the mix recipes, access modes for maintenance, adjust filling parameters, and manually operate the system. The user menu includes a "Loaded Now" window that display the pumping recipe currently loaded. Additionally, the menu allows the following menu selections:

- diagnostics, for self-test and calibration;
- direct control, for direct manual control of the filling process;
- performance, for displaying system data relating to motor loads, internal controller temperatures, etc.
- model/serial, for entry of the selected pump model and unique serial number assigned to each unit
- recipe 91, for viewing, loading and deleting previously-defined recipes;
- counter 93, for counting the fills;
- settings, for basic system settings (screen brightness, etc.); and
- boot up, for initiating software boot up or reboot.

By these controls an operator can run a pre-loaded mix recipe, modify a pre-loaded recipe, or enter a diagnostic mode to use the automatic calibrate function to fine tune the fill weight. Each defined recipe includes the following data fields (where applicable) for the particular pump selected:

- pump type: selection of the particular pump type and size
- tubing size (mm): the inside diameter of tubing for the peristaltic pump 6 attachment;
- fill volume (ml): the fill volume of liquid desired per dose;
- specific gravity: the specific gravity of fluid being filled;
- accel (%): the acceleration of pump head from Off to Speed 1, Speed 1 to Speed 2 (if Speed 2 is higher than Speed 1), and Speed 2 to Speed 3 (if Speed 3 is higher than Speed 2);
- decel (%): the deceleration of pump from Speed 1 to Speed 2 (if Speed 2 is lower than Speed 1), Speed 2 to Speed 3 (if Speed 3 is lower than Speed 2), and Speed 3 to Off;
- speed 1 (rpm): the initial speed of pump head;
- speed 2 (rpm): the second speed of pump head;
- speed 3 (rpm): the third speed of pump head;
- drawback speed (rpm): the drawback speed of pump head;
- % fill @ speed 1: the percentage of fill volume to be dispensed at speed 1;

% fill @ speed 2: the percentage of fill volume to be dispensed at speed 2 (If % fill @ speed 1+% fill @ speed 2 is less than the total fill volume, then the left over percentage will be dispensed at speed 3); and % drawback: the percentage of fill volume to be drawn back.

Figure 7A:
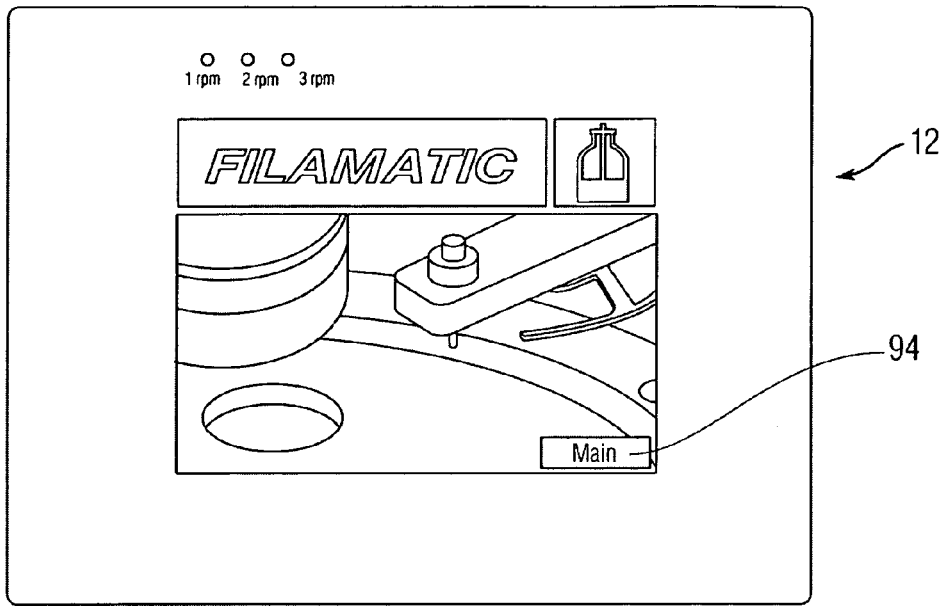
FIGS. 7A through 7G are an exemplary images of the operator interface displayed on the touch-screen controller to create or modify a liquid dispensing recipe.
Figure 7B:
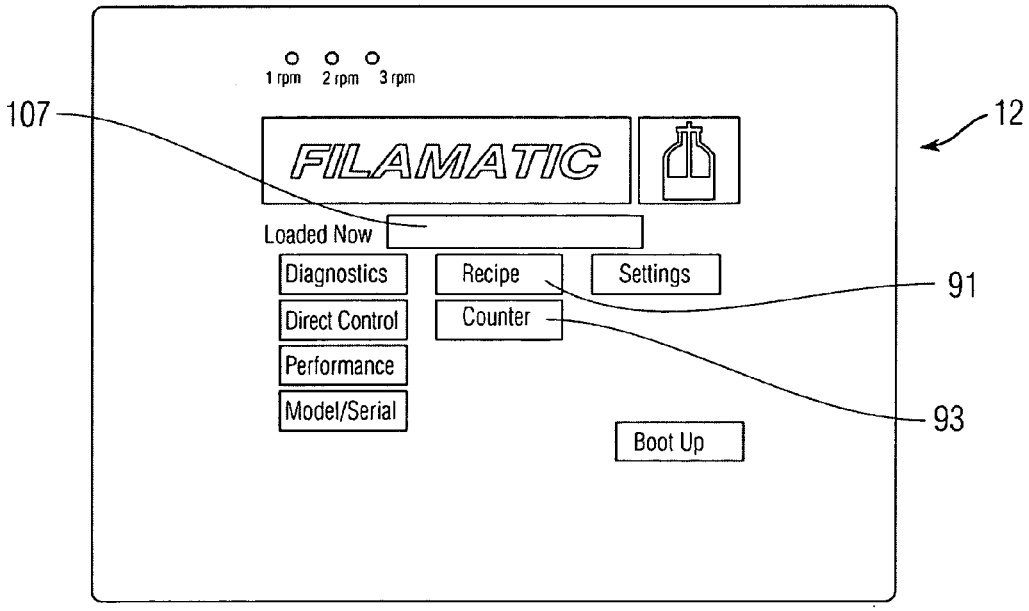
Figure 7C:
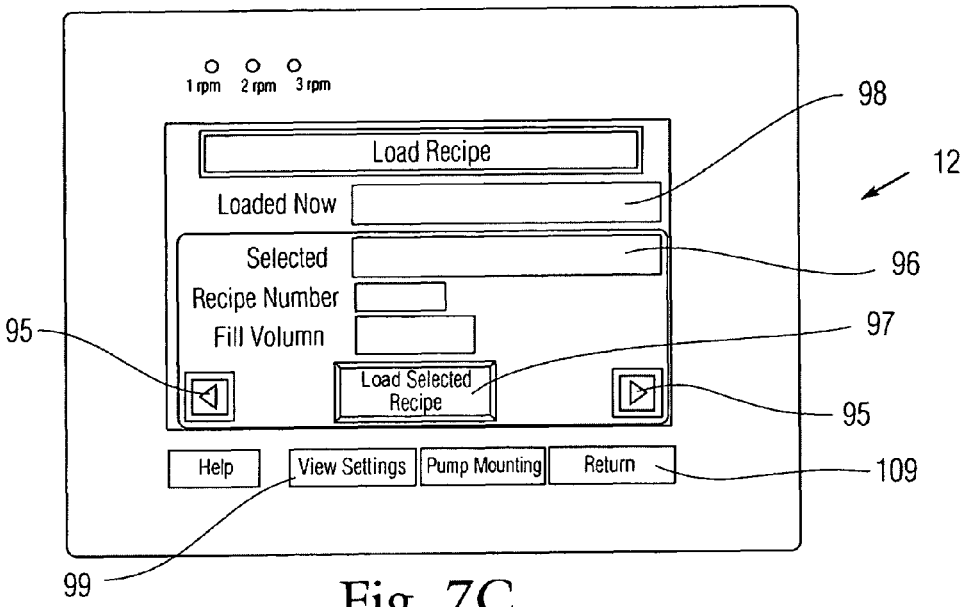
Figure 7D:
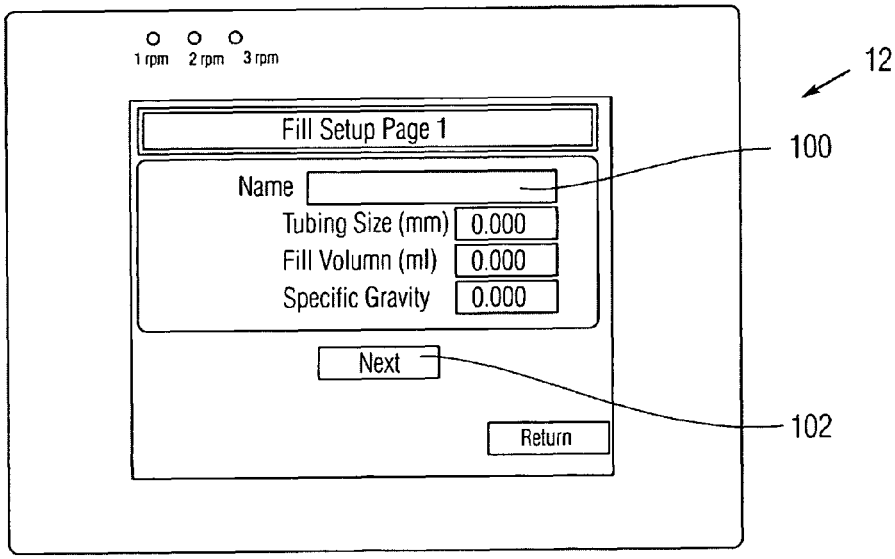
Figure 7E:
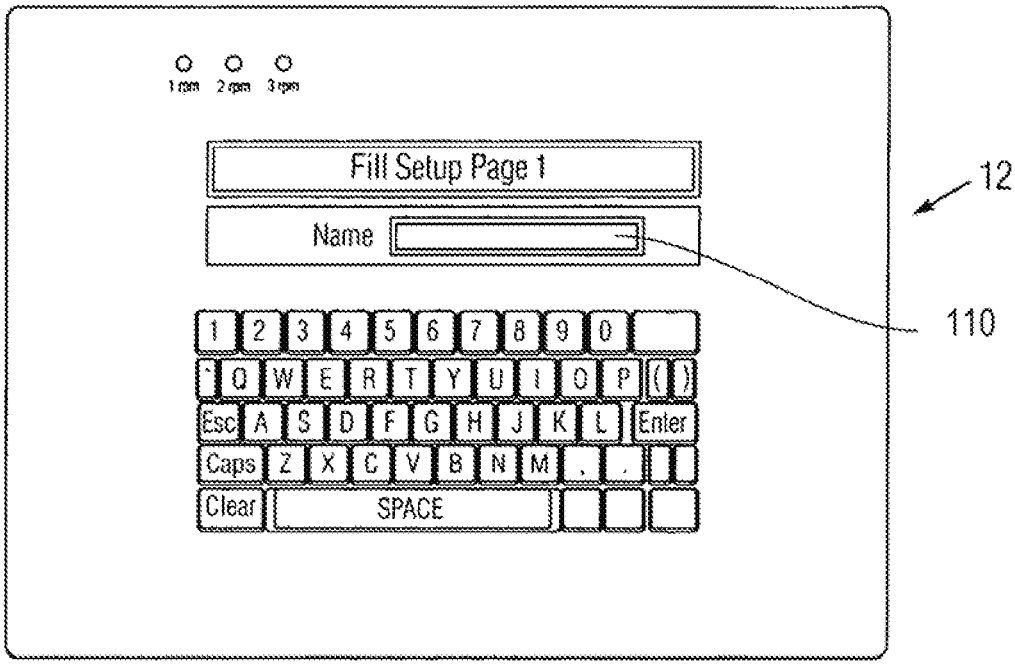
Figure 7F:
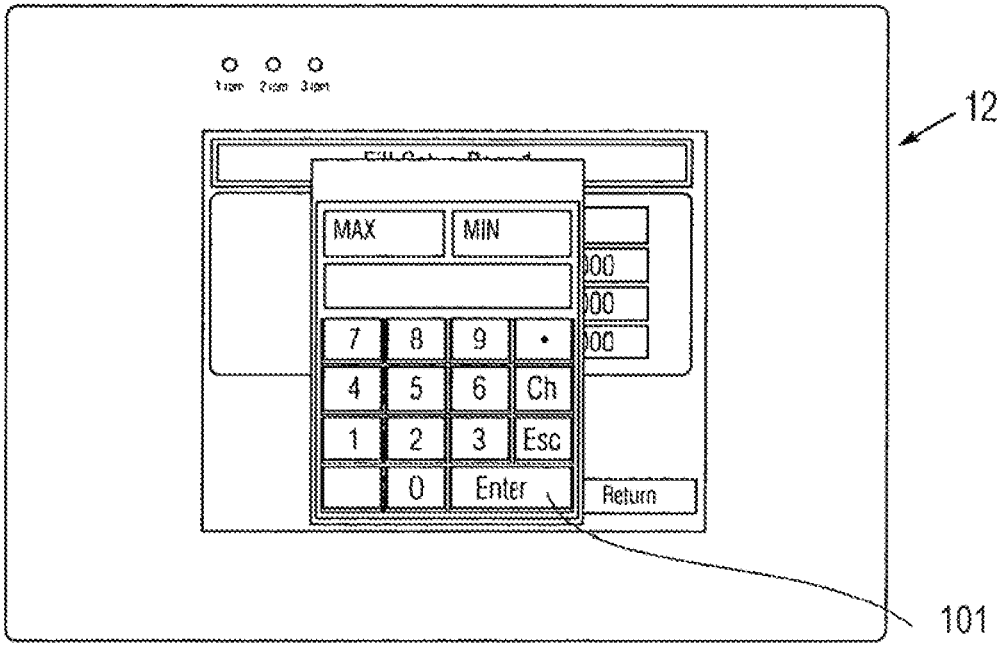
Figure 7G:
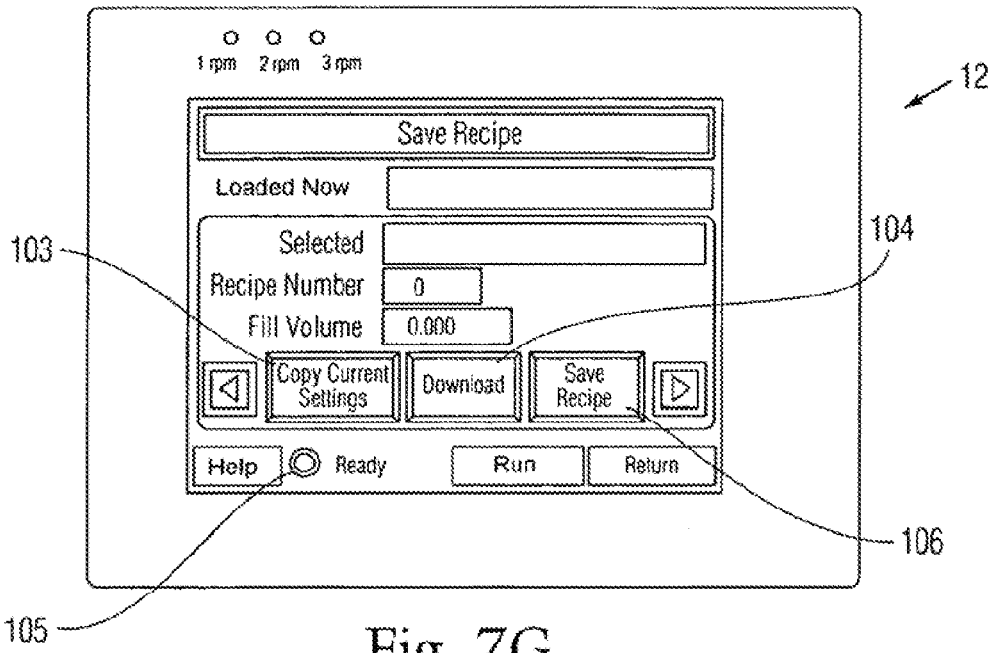

With reference to FIG. 7A through 7G, the operator interface user-menu presented on the touch-screen controller 12 for creating or modifying a liquid dispensing recipe are recited. After turning the power on and waiting for the boot up process to complete the "Main" button 94 to is pressed to navigate to the main menu (FIGS. 6 and 7B). The "Recipes" button 91 is pressed and the "Load Recipe" screen (FIG. 7C) is presented. A recipe number is selected by using the left and right arrow buttons 95. If creating a new recipe select a recipe number such that the "Selected" field 96 is blank. When the desired recipe number is displayed the "Load Recipe" button 97 is pressed to load the recipe. The "Loaded Now" field 98 will turn blank for a new recipe or display the name of the recipe selected. The "View Settings" button 99 is pressed to display the first of three "Fill Setup" screens (FIG. 7D is exemplary) to begin creating/modifying the recipe parameters. For a new recipe the "Name" field 110 is pressed to open the keypad screen (FIG. 7E) and enter the desired name of the recipe. Press each field successive field to enter the appropriate values by using the on screen number pad (FIG. 7F) and pressing the "Enter" button 101. The fields for the first Fill Setup Screen are listed in Table 1.

TABLE 1

Fill Settings Page 1 - Fields

| Name | Min Value | Max Value | Description |
|---|---|---|---|
| Tubing Size (mm) | 0 | 99 | Inside diameter of tubing. |
| Fill Volume (ml) | 0 | 1000 | Fill volume of liquid desired per dose. |
| Specific Gravity | 0.5 | 1.5 | Specific gravity of fluid being filled. |

After setting all values, press the "Next" button 102 to navigate to the next "Fill Setup" screen. The fields for the second Fill Setup Screen are listed in Table 2.

TABLE 2

Fill Settings Page 2 - Fields

| Name | Min Value | Max Value | Description |
|---|---|---|---|
| Accel (%) | 1 | 100 | Acceleration of pump head from off to Speed 1, Speed 1 to Speed 2 (if Speed 2 is higher than Speed 1), and Speed 2 to Speed 3 (if Speed 3 is higher than Speed 2). |
| Decel (%) | 1 | 100 | Deceleration of pump from Speed 1 to Speed 2 (if Speed 2 is lower than Speed 1), Speed 2 to Speed 3 (if Speed 3 is lower than Speed 2), and Speed 3 to off. |
| Speed 1 (rpm) | 1 | 210 | Initial speed of pump head in revolutions per minute. |
| Speed 2 (rpm) | 1 | 210 | Second speed of pump head in revolutions per minute. |
| Speed 3 (rpm) | 1 | 210 | Third speed of pump head in revolutions per minute. |
| Drwbk Speed (rpm) | 1 | 210 | Draw back speed of pump head in revolutions per minute. |

After setting all values, again press the "Next" button 102 to navigate to the next "Fill Setup" screen. The fields for the third Fill Setup Screen are listed in Table 3.

TABLE 3

Fill Settings Page 3 - Fields

| Name | Min Value | Max Value | Description |
|---|---|---|---|
| % Fill @ Speed 1 | 1 | 100 | Percentage of Fill Volume to be dispensed at Speed 1. |
| % Fill @ Speed 2 | 0 | 100 | Percentage of Fill Volume to be dispensed at Speed 2. (If % Fill @ Speed 1 + % Fill @ Speed 2 is less than the total fill volume, then the left over percentage will be dispensed at Speed 3) |
| % Drawback | 0 | 100 | Percentage of Fill Volume to be drawn back. |

After completing the third "Fill Setup" screen, the "Save Recipe" screen will appear. The "Copy Current Settings" button 103 is pressed. The "Download" button 104 and the green "Ready" light 105 is lit when the recipe has been downloaded and/or validated at which point it can be saved by pressing the "Save Recipe" 106.

Figure 8:
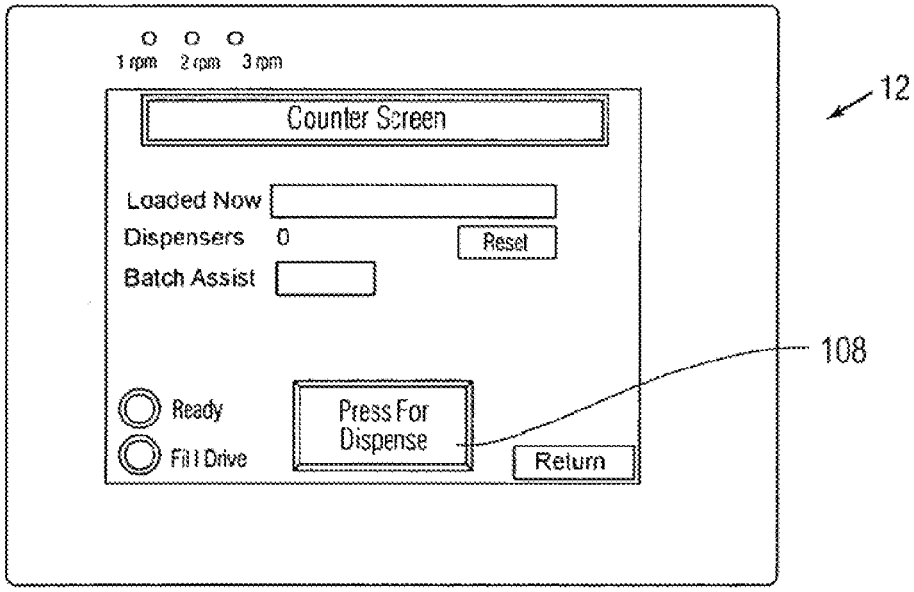
FIG. 8 is an exemplary image of the operator interface displayed on the touch-screen controller to run a previously stored and currently loaded liquid dispensing recipe.

To run an already loaded recipe displayed in the "Loaded Recipe" field 107 of the main menu (FIG. 7A), the "Counter" button 93 is selected to display the Counter Screen (FIG. 8). The "Press For Dispense" button 108 is pressed to dispense a dose of the liquid according to the loaded recipe. To run an unloaded recipe, the Recipe button 91 on the main menu (FIG. 6) is selected to reach the "Load Recipe" screen (FIG. 7C). A recipe number is selected by using the left and right arrow buttons 95 as described above and the "Load Recipe" button 97 is pressed when the desired recipe is displayed to load the recipe. The "Loaded Now" field 98 will display the name of the recipe selected. The Return button 109 is pressed to display the main menu and the Counter" button 93 is selected to display the Counter Screen (FIG. 8). The "Press For Dispense" button 108 is pressed to dispense a dose of the liquid according to the loaded recipe.

Figure 9:
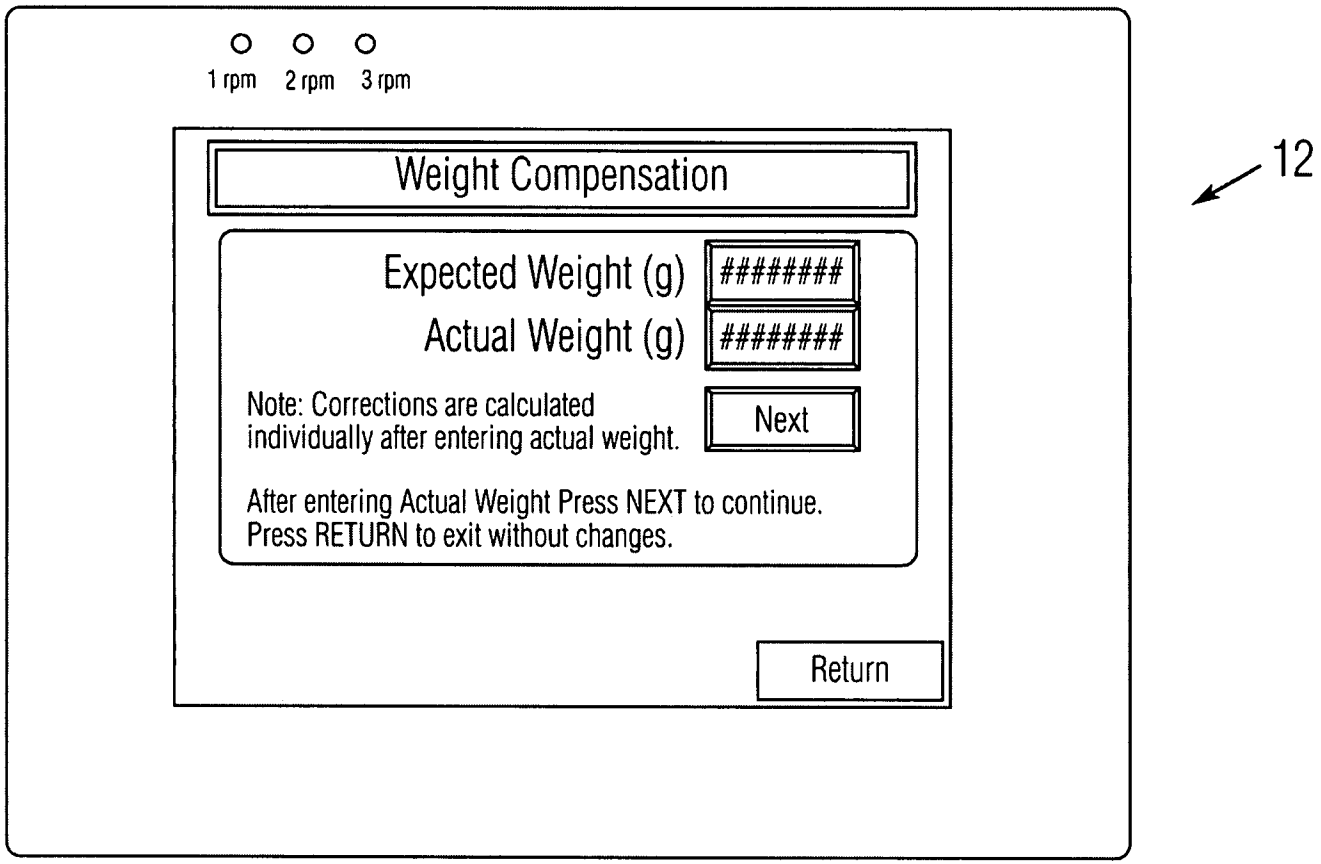
FIG. 9 is an exemplary image of the actual dispensed weight data entry screen displayed on the touch-screen controller

When switching between pump types or even between individual pumps of the same type it is sometimes advisable to calibrate the filling system 2 to account for variations in individual units. The weight compensation feature includes an auto-guided calibration function by which a user can calibrate the fill weight and manually adjust the number of rotations (or partial rotations) to be made by the servo motor 40 and thus changing the precise fill volume. The procedure is generally conducted by first weighing samples of the containers to be filled in a particular batch to determine a tare weight. An operator then uses the system 2 to fill the sample containers and re weighs each sample container to determine a gross weight. The tare weight is then subtracted from gross weight for each sample container to determine actual dispensed weight of the fluid in each sample container. The actual weight and the expected or target fill weight are entered into the system 2 via keypad input screen (FIG. 9) of the touch-screen controller 12. The software will then automatically adjust the number of servo motor turns required to precisely dispense the correct weight. More specifically, the software will proportionally modify the number of pulses needed to drive the servo motor the number of turns required to achieve exactly the intended fill volume. An electronic signal is sensed many times for each revolution of the drive motor giving the controller precise control over the rotation of the motor and thus operation of the then attached pump. In some embodiments a target volume may be entered for liquids having a known specific gravity from which a target weight may be calculated. For example, if 10 ml of a product was selected and 12 grams of product was dispensed, the drive will adjust itself proportionately to dispense 10 grams on the next fill. After adjustment the operator should test fill one or more sample containers to verify the adjustment.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A bench top system for filling containers with liquid using any two or more pumps from among a group of peristaltic, lobe, gear and piston pumps, comprising:

a base unit including, a housing, a controller having a display, a servo motor control system in communication with said controller, a servo motor connected to said servo motor control system, a first reduction gearbox coupled between said servo motor and an adapter for driving any one of said peristaltic, lobe, and gear pumps; and a second reduction gearbox coupled to said first reduction gearbox, said second reduction gearbox being coupled to a second adapter for driving said piston pump.

2. The bench top system of claim 1 wherein said adapter further comprises a mounting plate adapted to be affixed to each of said two or more pumps for mounting said pumps to said housing, each plate having a central drive aperture.

3. The bench top system of claim 2 further comprising a quick disconnect flexible coupling in said central drive aperture of each said mounting plate for removable engagement with said first reduction gearbox to drive each of said two or more pumps.

4. The bench top system of claim 3 wherein said quick disconnect flexible coupling is a bellows coupling.

5. The bench top system of claim 2 wherein said mounting plates are mounted to said housing by cooperative engagement of a plurality of twist-lock bayonet pins in corresponding plurality of holes in said housing.

6. The bench top system of claim 1 further comprising an adjustable height mounting post for a fixed end of said piston pump, said mounting post slideably retained in a slot of a mounting plate by a screw; and a safety guard enclosing said adjustable height mounting post on at least two sides and electrically interlocked with said servo motor control system to prevent operation of said servo motor in the absence of said safety guard.

7. A bench top system for filling containers with liquid using any two or more pumps comprising:

a controller having a display, a servo motor control system in communication with said controller, a servo motor connected to said servo motor control system, a first reduction gear coupled between said servo motor and a first adapter for driving a pump;

a first pump removably connectable to said adapter, said first pump being of a type selected from the group consisting of peristaltic, lobe and gear pumps a second reduction gear coupled to said first reduction gear, said second reduction gear being coupled to a second adapter for driving a pump; and a second pump removably connectable to said second adapter.

8. The bench top system of claim 7 wherein said second pump is of a type selected from the group consisting of peristaltic, lobe and gear pumps.

9. The bench top system of claim 7 wherein said second pump is a piston pump.

* * * * *